US007707802B2

(12) United States Patent
Forrest

(10) Patent No.: US 7,707,802 B2
(45) Date of Patent: May 4, 2010

(54) FILM ROPING ASSEMBLY FOR USE WITHIN FILM WRAPPING OR PACKAGING MACHINES

(75) Inventor: Stephen G. Forrest, Quebec (CA)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 12/073,142

(22) Filed: Feb. 29, 2008

(65) Prior Publication Data

US 2009/0217624 A1 Sep. 3, 2009

(51) Int. Cl.
*B65B 11/02* (2006.01)
*B65B 13/04* (2006.01)

(52) U.S. Cl. ..... 53/399; 53/441; 53/556; 53/389.2

(58) Field of Classification Search ..... 53/399, 53/441, 556, 587–589, 389.2
See application file for complete search history.

(56) References Cited

U.S. PATENT DOCUMENTS 4,587,796 A 5/1986 Haloila
4,807,427 A * 2/1989 Casteel et al. ..... 53/556
5,107,657 A * 4/1992 Diehl et al. ..... 53/389.2
5,515,973 A * 5/1996 Sharp ..... 206/497
5,517,807 A 5/1996 Morantz
5,787,691 A 8/1998 Turfan
6,195,961 B1 3/2001 Turfan
6,360,512 B1 * 3/2002 Marois et al. ..... 53/399
6,745,544 B2 * 6/2004 Matsumoto et al. ..... 53/399
6,955,027 B2 * 10/2005 Suolahti ..... 53/389.2

FOREIGN PATENT DOCUMENTS

CA 2287675 A1 * 4/2001

* cited by examiner

*Primary Examiner*—Stephen F Gerrity
(74) *Attorney, Agent, or Firm*—Law Offices of Steven W. Weirieb

(57) ABSTRACT

A film roping assembly comprises a roping pulley which is disposed upon the wrapping film dispensing carriage assembly. The roping pulley is vertically reciprocable so as to be movable transversely, across the width of the wrapping film, with respect to the direction in which the wrapping film is being dispensed. The roping pulley is initially disposed at its uppermost position and engages the upper edge portion of the film. As the roping pulley is moved vertically downwardly, the film is condensed or gathered so as to form a roped section of the wrapping film. The process may be repeated throughout a single wrapping operation so as to provide the wrapped film with both roped and non-roped sections.

24 Claims, 9 Drawing Sheets

FILM ROPING ASSEMBLY FOR USE WITHIN FILM WRAPPING OR PACKAGING MACHINES

FIELD OF THE INVENTION

The present invention relates generally to film wrapping or packaging machines, and more particularly to a new and improved film roping assembly, disposed upon the wrapping or packaging film dispensing carriage assembly, for effectively forming a rope from the film wrapping or packaging material as a result of effectively compressing, condensing, or gathering of the film wrapping or packaging material along its width dimension whereby the formed rope effectively exhibits enhanced resistance to stretching and tearing. When such roped film is utilized in conjunction with non-roped film wrapping or packaging material, the entire composite film wrapping or packaging material, comprising the roped and non-roped portions of the film wrapping or packaging material, significantly enhances the ability of the film wrapping or packaging material to hold uneven, sharp, pointy, abrasive, unstable, and heavy products upon a pallet. In addition, the roped film can also be wrapped or secured around both the pallet load and the pallet per se whereby the pallet load is effectively fastened to the pallet per se so as to prevent separation of the pallet load from the pallet per se, and in addition, to render the entire pallet assembly much more resistant to tilting, vibrating, shaking, and instability.

BACKGROUND OF THE INVENTION

Film wrapping or packaging machines or apparatus, for wrapping articles, packages, or palletized loads within wrapping or packaging film, are of course well known in the art. Examples of such film wrapping machines or apparatus are disclosed within U.S. Pat. No. 6,195,961 which issued to Turfan_on Mar. 6, 2001, U.S. Pat. No. 5,787,691 which issued to Turfan on Aug. 4, 1998, U.S. Pat. No. 5,517,807 which issued to Morantz on May 21, 1996, and U.S. Pat. No. 4,587,796 which issued to Haloila on May 13, 1986. In addition, or in conjunction with the aforenoted patented disclosure, it is known that there are several different types of conventional film wrapping or packaging machines. Briefly, for example, a turntable type film wrapping or packaging machine is disclosed within FIG. 1 and is generally indicated by the reference character 100. In accordance with such a turntable type film wrapping or packaging machine 100, a palletized load, not shown, is adapted to be placed upon a turntable 102, and a wrapping or packaging film dispensing carriage assembly 104 is movably mounted in a vertically reciprocable manner upon an upstanding standard or support mast 106. Accordingly, as the palletized load is rotated around the rotary axis of the turntable 102, and as the wrapping or packaging film dispensing carriage assembly 104 is moved in a vertically reciprocable manner, either from its uppermost position to its lowermost position, or from its lowermost position to its uppermost position, the wrapping or packaging film, dispensed from the wrapping or packaging film dispensing carriage assembly 104, wraps or packages the palletized load within the wrapping or packaging film.

Continuing further, a rotary arm type film wrapping or packaging machine is disclosed within FIG. 2 and is generally indicated by the reference character 200. In accordance with such a rotary arm type film wrapping or packaging machine 200, an upstanding framework 202 effectively defines a film wrapping or packaging station 204 at an axially central portion thereof, and a palletized load, not shown, which is to be wrapped or packaged within film wrapping or packaging material, is adapted to be disposed at such film wrapping or packaging station 204. A rotary arm assembly 206, which is rotatably mounted upon an upper frame member 208 of the up-standing framework 202, is adapted to rotate around the film wrapping or packaging station 204, and a wrapping or packaging film dispensing carriage assembly 210 is movably mounted in a vertically reciprocable manner upon the rotary arm assembly 206. Accordingly, as the rotary arm assembly 206 is rotated around the film wrapping or packaging station 204, and as the wrapping or packaging film dispensing carriage assembly 210 is moved in a vertically reciprocable manner, either from its uppermost position to its lowermost position, or from its lowermost position to its uppermost position, the wrapping or packaging film, dispensed from the wrapping or packaging film dispensing carriage assembly 210, wraps or packages the palletized load within the wrapping or packaging film.

Lastly, a rotary ring type film wrapping or packaging machine is disclosed within FIG. 3 and is generally indicated by the reference character 300. In accordance with such a rotary ring type film wrapping or packaging machine 300, an upstanding framework 302 effectively defines a film wrapping or packaging station 304 at an axially central portion thereof, and a palletized load, not shown, which is to be wrapped or packaged within film wrapping or packaging material, is adapted to be disposed at such film wrapping or packaging station 304. A rotary ring member 306 is rotatably mounted upon a frame member 308 so as to rotate around the film wrapping or packaging station 304, and the frame member 308 is adapted to be movably mounted in a vertically reciprocable manner upon the upstanding framework 302. In addition, a wrapping or packaging film dispensing carriage assembly, not visible, is fixedly mounted upon the rotary ring member 306. Accordingly, as the rotary ring member 306 is rotated around the film wrapping or packaging station 304, and as the frame member 308 is moved in a vertically reciprocable manner, either from its uppermost position to its lowermost position, or from its lowermost position to its uppermost position, the wrapping or packaging film, dispensed from the wrapping or packaging film dispensing carriage assembly, wraps or packages the palletized load within the wrapping or packaging film.

Regardless of which type of conventional film wrapping or packaging machine is utilized to wrap or package palletized loads within wrapping or packaging film, an operative objective of the film wrapping or packaging process or procedure is to ensure that the strength of containment, or the holding together of, for example, multiple portions of the overall palletized load, is adequate or sufficient such that the different portions or sections of the overall palletized load do not separate from each other. A similar operative objective of the film wrapping or packaging process or procedure is to likewise ensure that the strength of containment, or the holding together of, for example, the entire or composite palletized load upon or onto the pallet per se, is also adequate or sufficient such that the palletized load does not separate from the pallet per se.

It has been determined that one means for achieving the aforenoted objectives is to effectively form the film wrapping or packaging material into a rope in view of the fact that the rope effectively exhibits enhanced resistance to stretching and tearing. Accordingly, if such a roped film was to be utilized in conjunction with non-roped film wrapping or packaging material, the entire composite film wrapping or packaging material, comprising the roped and non-roped portions of the film wrapping or packaging material, could significantly enhance the ability of the film wrapping or packaging material to hold uneven, sharp, pointy, abrasive, unstable, and heavy products upon the pallet. In addition, by applying or securing the roped film around both the pallet load and the pallet per se, the pallet load would be effectively fastened to the pallet per se so as to prevent the separation of the pallet load from the pallet per se, and in addition, could render the entire pallet assembly much more resistant to tilting, vibrating, shaking, and instability. The operative problem, however, is that, to date, no viable means has been developed in order to in fact achieve the formation of such a roped wrapping or packaging film during the film wrapping or packaging operation in order to in fact achieve the aforenoted procedural objectives.

A need therefore exists in the art for apparatus for forming roped portions of film wrapping or packaging material during a film wrapping or packaging procedure or operation whereby such roped portions of the wrapping or packaging film can be applied to strategic portions or sections of the palletized load in order to maintain different portions or sections of the palletized load together, or to fixedly maintain the entire composite palletized load upon the load pallet.

SUMMARY OF THE INVENTION

The foregoing and other objectives are achieved in accordance with the teachings and principles of the present invention through the provision of a new and improved film roping assembly which is disposed upon the wrapping or packaging film dispensing carriage assembly and which effectively forms a rope from the film wrapping or packaging material as a result of effectively compressing, condensing, or gathering the wrapping or packaging film along its width dimension. More particularly, a roping pulley is mounted upon the wrapping or packaging film dispensing carriage assembly so as to be movable in a vertically reciprocable manner. At the beginning of a film wrapping or packaging operation, the roping pulley is disposed at its uppermost position so as to be disposed directly above the upper edge portion of the wrapping or packaging film, being dispensed from the wrapping or packaging film dispensing carriage assembly, such that the annular groove of the roping pulley is, in effect, aligned in a coplanar manner with the wrapping or packaging film. Accordingly, when it is desired to form a roped portion of the packaging or wrapping film, the roping pulley is moved vertically downwardly such that the upper edge portion of the wrapping or packaging film will be disposed within the annular groove of the roping pulley, and as the roping pulley continues its downward movement, the wrapping or packaging film is effectively condensed or gathered along its width dimension or direction.

When the roping pulley effectively reaches its lowermost position, the wrapping or packaging film is completely formed into a roped section or portion of the wrapping or packaging film. This operative cycle can be repeated throughout a single film wrapping or packaging operation whereby different sections or portions of the wrapping or packaging film can comprise roped and non-roped structures so as to effectively dispose the roped portions or section of the wrapping or packaging film at strategic locations of the palletized load in order to significantly enhance the ability of the wrapping or packaging film to hold uneven, sharp, pointy, abrasive, unstable, and heavy products upon a pallet, to significantly enhance the ability of the wrapping or packaging film to hold different sections or portions of the palletized load together, or to significantly enhance the ability of the wrapping or packaging film to secure the composite palletized load upon the pallet.

BRIEF DESCRIPTION OF THE DRAWINGS

Various other features and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 7:
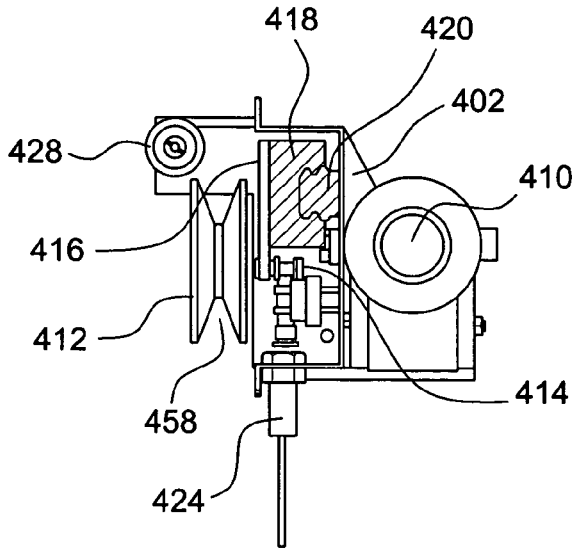
FIG. 7 is a cross-sectional view of the new and improved film roping assembly as taken along the lines 7-7 of FIG. 5 so as to illustrate the details of how the roping pulley is movably mounted upon the film roping assembly.
Figure 4:
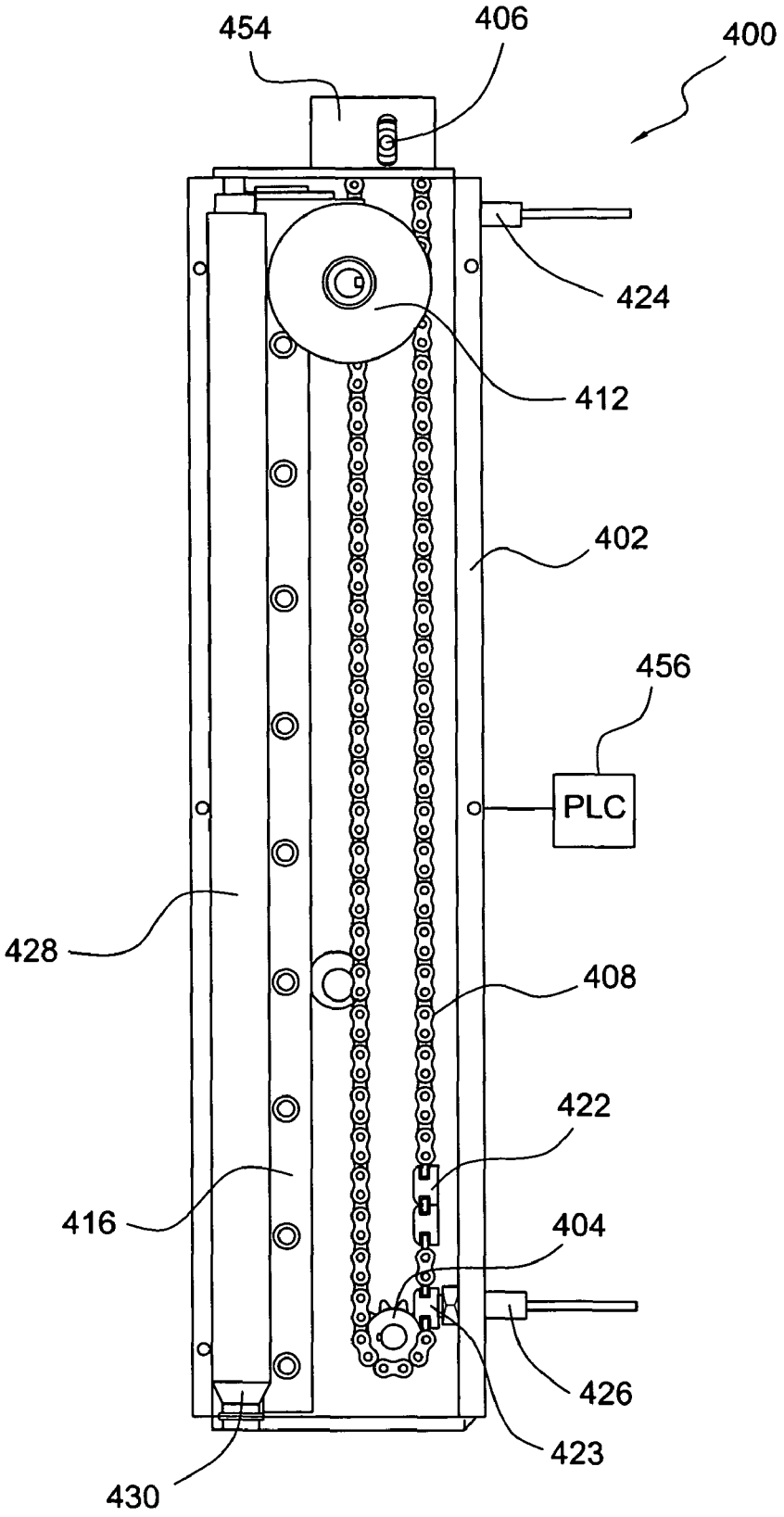
FIG. 4 is a front elevational view of a new and improved film roping assembly, as constructed in accordance with the principles and teachings of the present invention, for use with film wrapping or packaging machines, in order to provide roped sections of the wrapping or packaging film that may utilized at strategic locations upon a palletized load being wrapped or packaged within the wrapping or packaging film.
Figure 5:
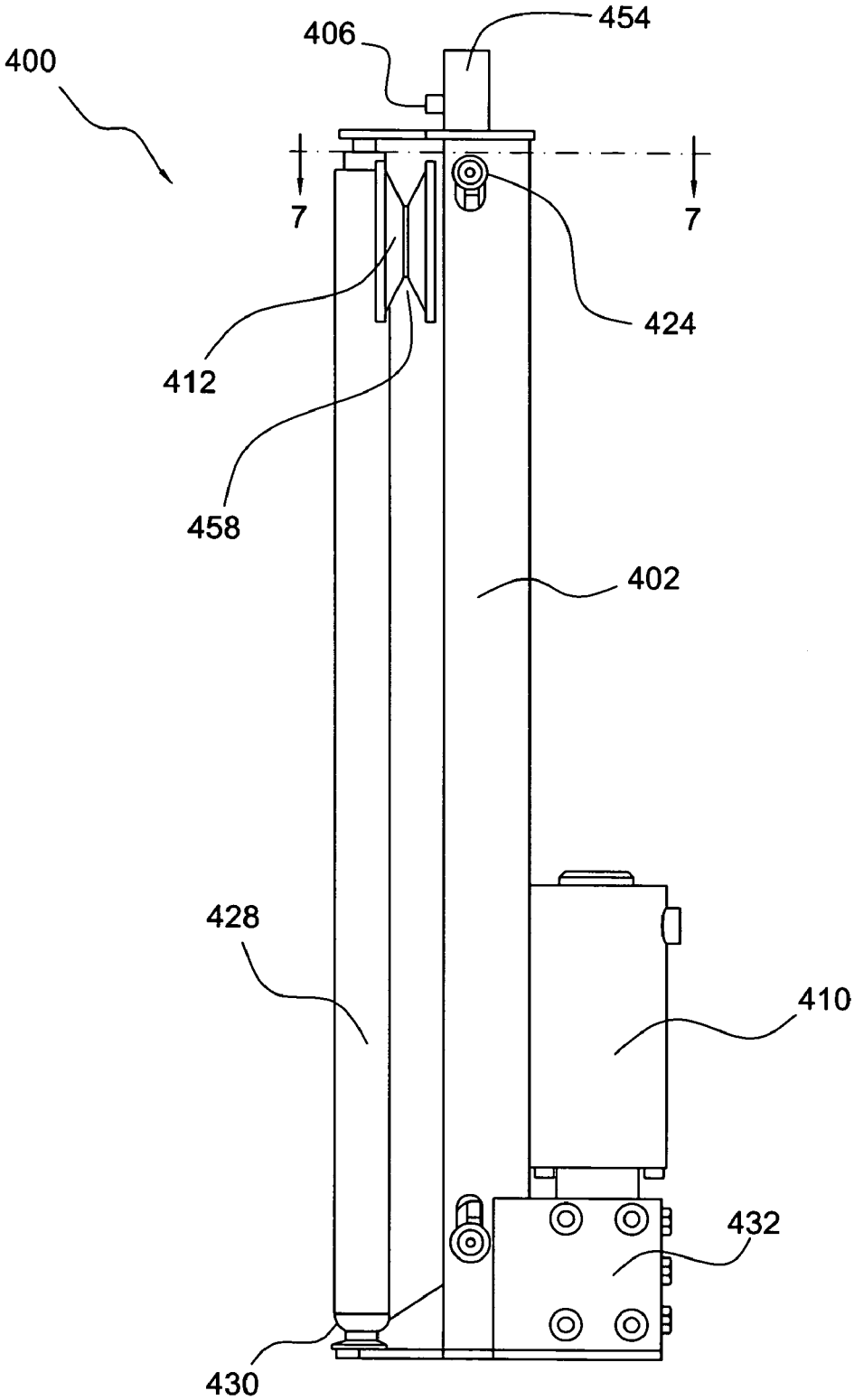
FIG. 5 is a side elevational view of the new and improved film roping assembly as disclosed within FIG. 4.
Figure 6:
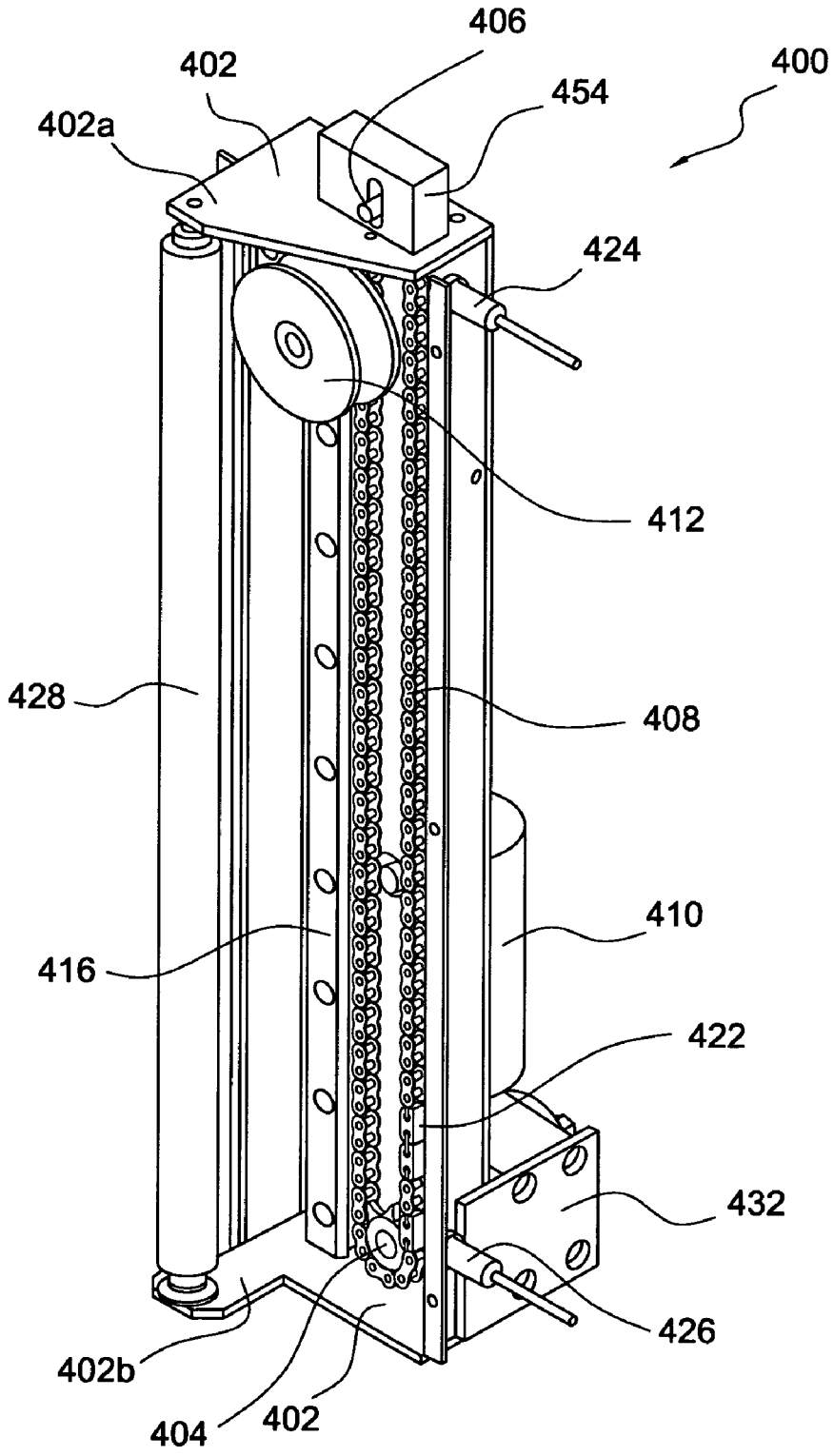
FIG. 6 is a front perspective view of the new and improved film roping assembly as disclosed within FIGS. 4 and 5.

Referring now to the drawings, and more particularly to FIGS. 4-7 thereof, a new and improved film roping assembly, as constructed in accordance with the principles and teachings of the present invention, is disclosed and is generally indicated by the reference character 400. More particularly, it is seen that the new and improved film roping assembly 400 comprises a framework 402 upon the lower end of which there is rotatably mounted a drive sprocket 404, and upon the upper end of which there is rotatably mounted an idler sprocket 406. Opposite ends of a vertically oriented endless drive chain 408 are respectively disposed around the drive sprocket 404 and the idler sprocket 406, wherein the idler sprocket 406 is adjustably mounted upon the framework 402 so as to provide the endless drive chain 408 with a proper amount of tension, and a reversible drive motor 410, as can best be seen in FIG. 5-7, is fixedly mounted upon the framework 402 such that the output drive shaft of the drive motor 410 is operatively connected to the drive sprocket 404. Therefore, depending upon the direction of rotation of the output drive shaft of the drive motor 410, that is, either in the clockwise direction or the counterclockwise direction, as viewed, for example, in FIG. 4, the drive sprocket 404 will be respectively driven in the clockwise or counterclockwise direction. Accordingly, the drive chain 408 will effectively be moved or driven either in the clockwise direction or the counterclockwise direction such that, for example, as viewed in FIG. 4, when the drive chain 408 is being moved or driven in the clockwise direction, the left side portion of the endless loop comprising the drive chain 408 will be moving vertically upwardly while the right side portion of the endless loop comprising the drive chain 408 will be moving vertically downwardly, and in a similar manner, when the drive chain 408 is being moved or driven in the counterclockwise direction, the left side portion of the endless loop comprising the drive chain 408 will be moving vertically downwardly while the right side portion of the endless loop comprising the drive chain 408 will be moving vertically upwardly.

Figure 9:
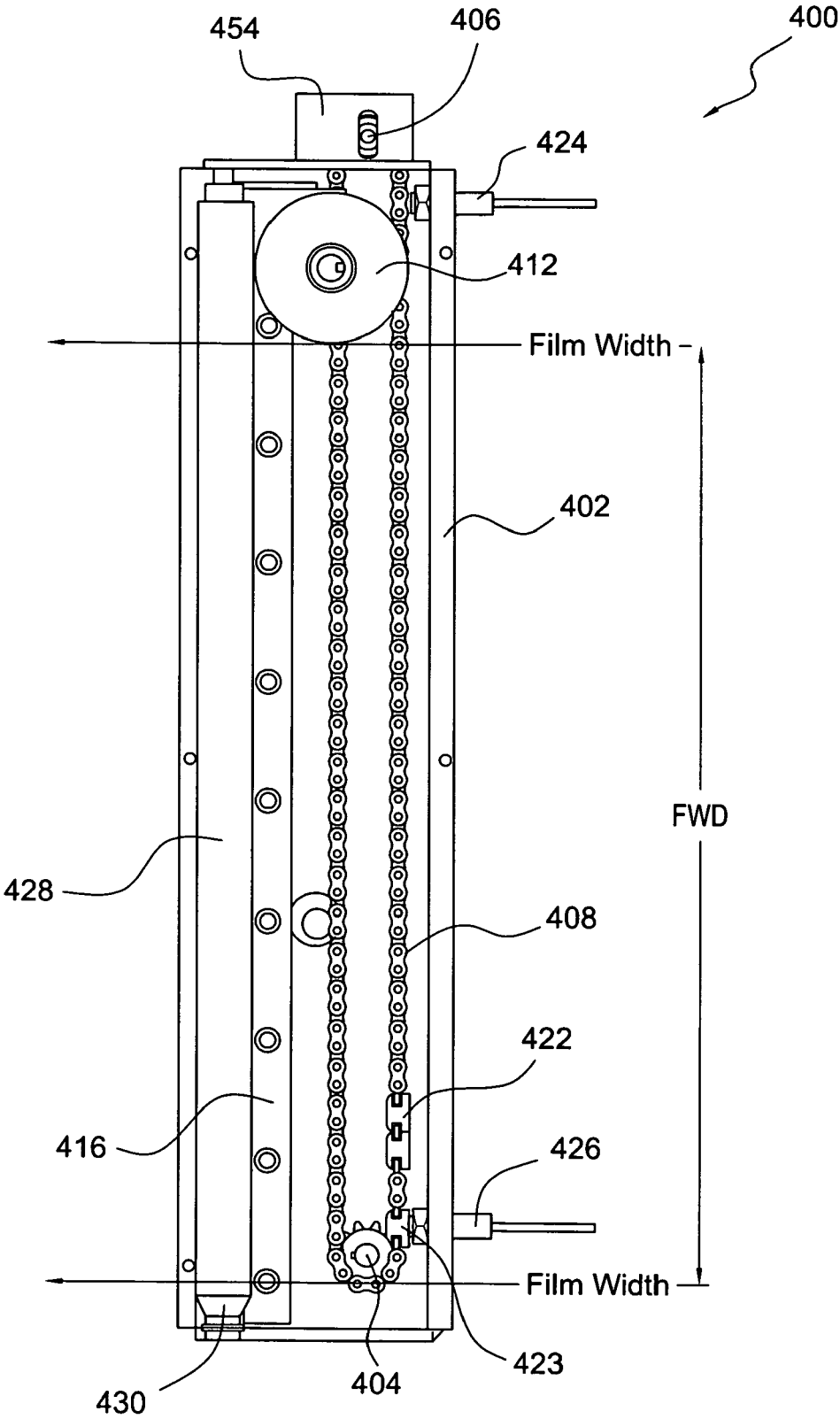
FIG. 9 is a front elevational view, similar to that of FIG. 1, illustrating the disposition of the roping pulley at its uppermost position so as to permit the wrapping or packaging film to pass beneath the roping pulley at its full width dimension.
Figure 10:
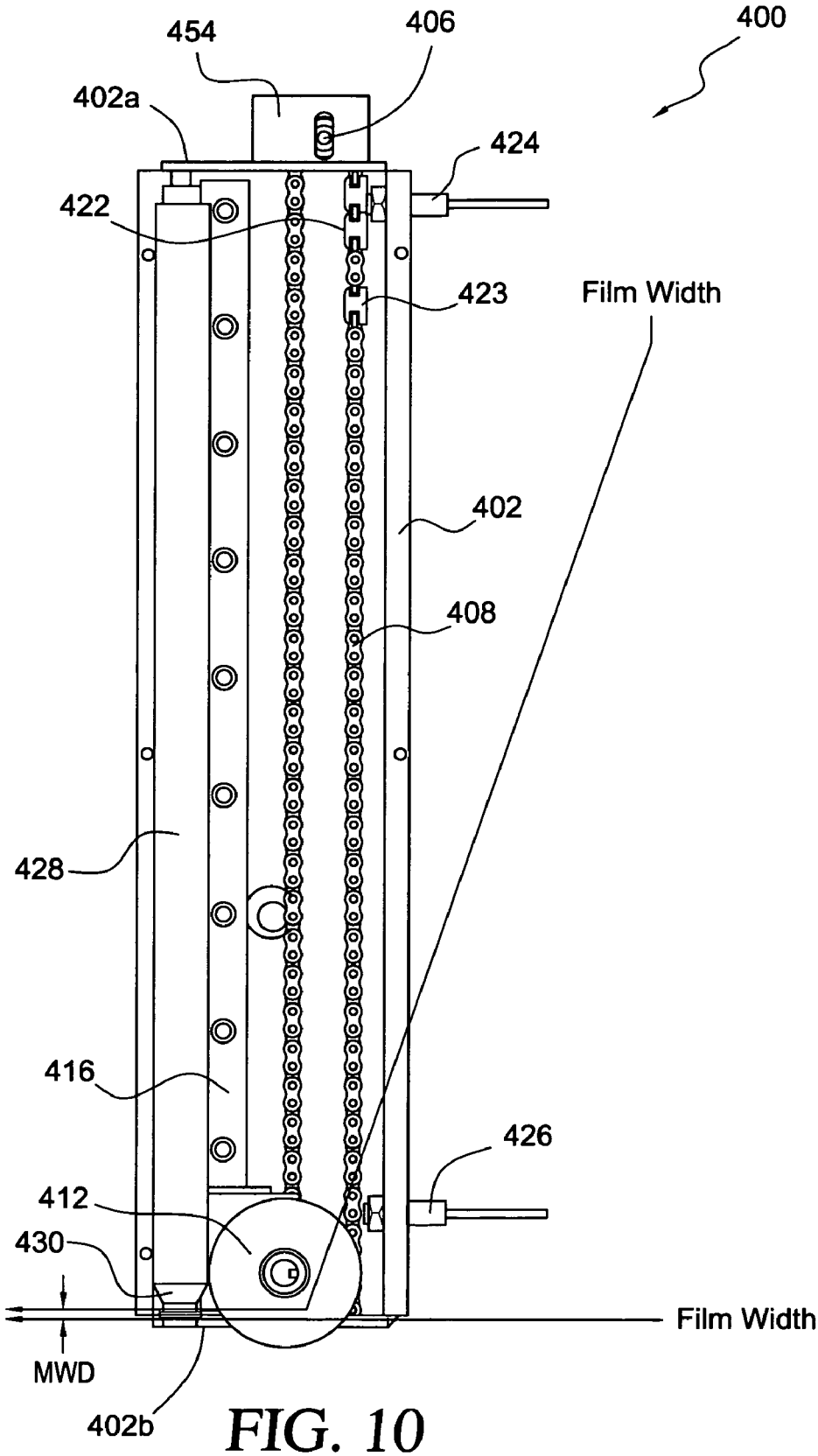
FIG. 10 is a front elevational view, similar to that of FIG. 9, illustrating, however, the disposition of the roping pulley at its lowermost position so as to cause the wrapping or packaging film to be formed into a roped film having its minimum width dimension.

A roping pulley 412 is adapted to be rotatably mounted upon the left side portion of the endless loop comprising the drive chain 408 so as to be movable with the drive chain 408 when the drive chain 408 is moved in accordance with the foregoing clockwise and counterclockwise directional movements whereby, for example, the roping pulley 412 will be vertically movable between an uppermost position as illustrated, for example, within FIG. 9, and a lowermost position as illustrated, for example, within FIG. 10, the purpose of which will be explained more fully hereinafter. In order to in fact mount the roping pulley 412 upon the left side portion of the endless loop comprising the drive chain 408, and with particular reference being made to FIG. 7, it is seen that the roping pulley 412 is rotatably mounted upon the distal or free end portion of a pin 414, and that the pin 414 is not only fixedly connected to one of the links of the endless drive chain 408, but in addition is also fixedly secured within a mounting bracket 416. The mounting bracket 416 is, in turn, fixedly mounted upon a guide block 418, and it is further appreciated that the guide block 418 is movably mounted upon a vertically oriented guide rail 420, which is fixedly mounted upon the framework 402, through means of a dovetail type connection. Still further, it is seen that a pair of proximity targets 422,423 which basically have elongated structures, are fixedly mounted or incorporated within the right side portion of the endless loop comprising the drive chain 408, and that a pair of upper and lower proximity sensors 424 and 426 are fixedly mounted upon upper and lower regions of the framework 402. The proximity sensors 424, 426 are electrically connected to the drive motor 410 and effectively act or serve as limit switches so as to terminate the particular directional drive of the drive motor 410, and the corresponding clockwise or counterclockwise movement of the drive chain 408, so as to respectively position the roping pulley 412 at either its lowermost or uppermost position as respectively illustrated within FIGS. 10 and 9.

Figure 1:
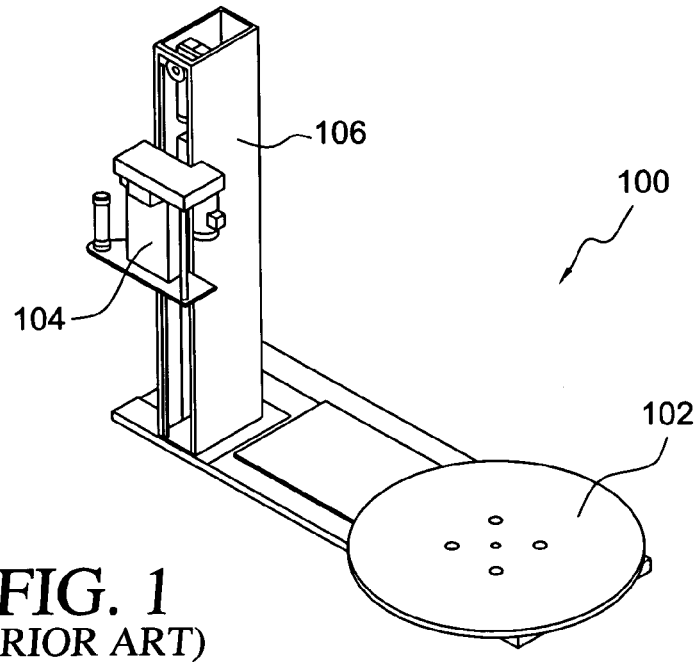
FIG. 1 (PRIOR ART)
FIG. 1 is a perspective view of a first conventional, PRIOR ART turntable type film wrapping or packaging machine.
Figure 2:
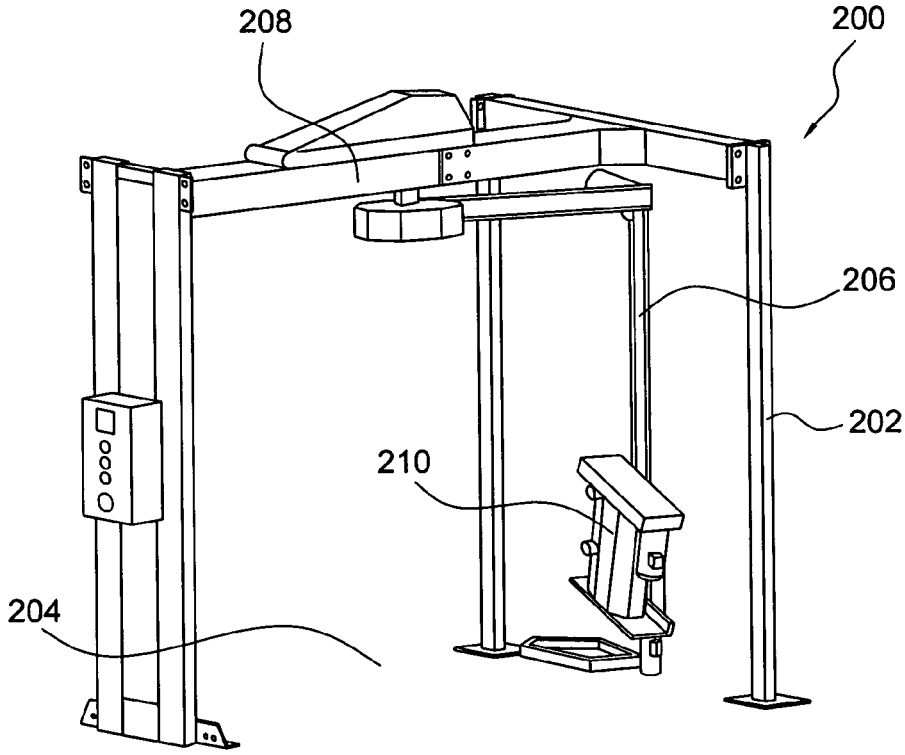
FIG. 2 (PRIOR ART)
FIG. 2 is a prespective view of a second conventional, PRIOR ART rotary arm type film wrapping or packaging machine.
Figure 3:
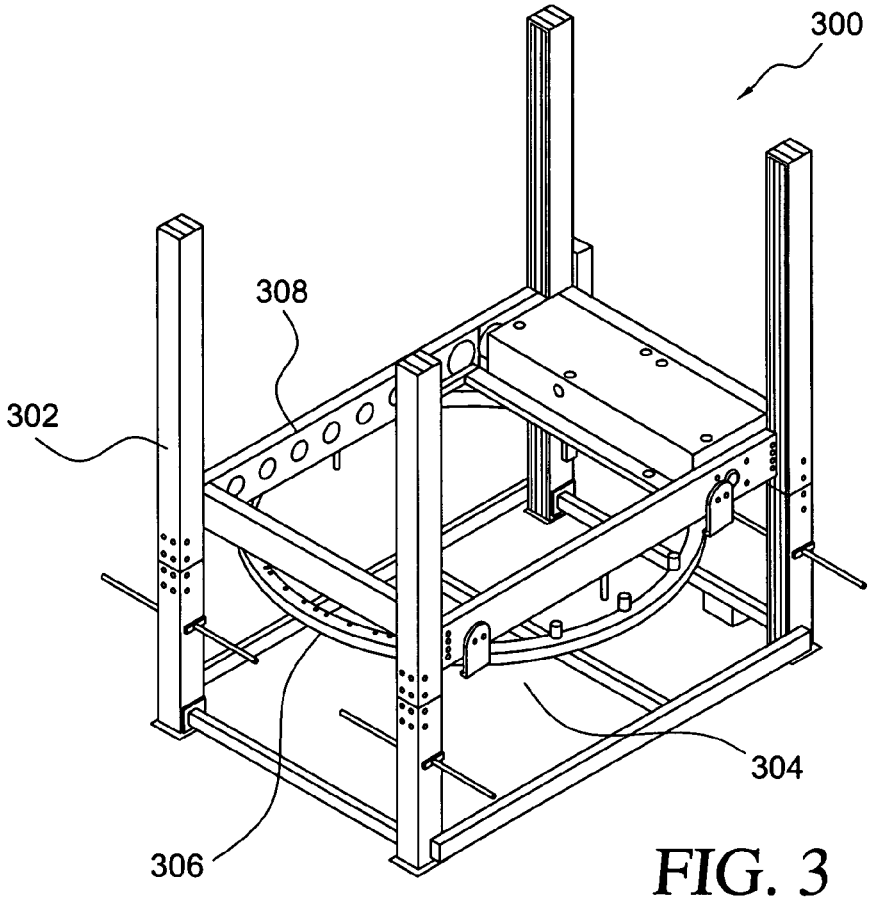
FIG. 3 (PRIOR ART)
FIG. 3 is a perspective view of a third conventional, PRIOR ART rotary ring type film wrapping or packaging machine.
Figure 8:
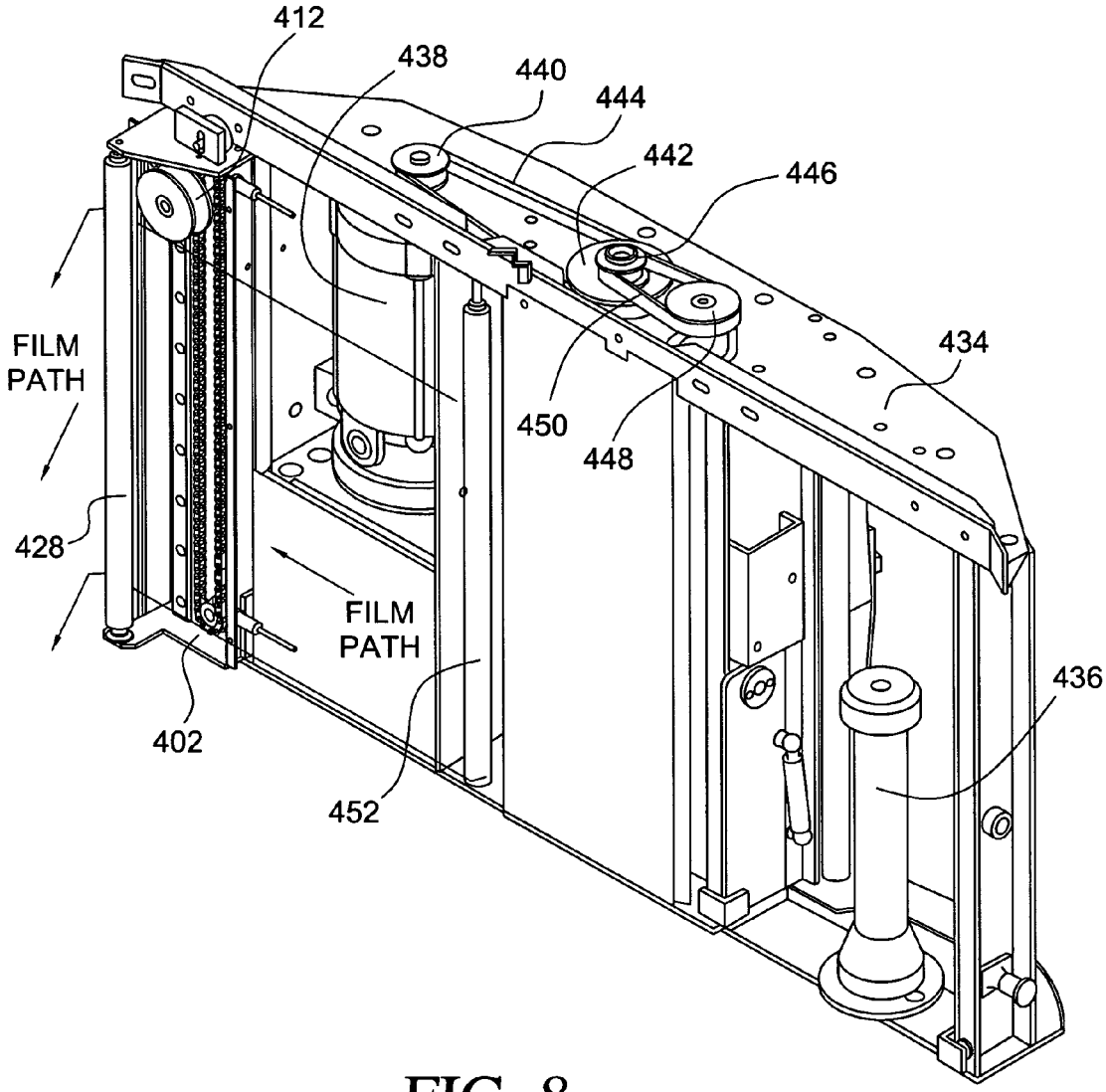
FIG. 8 is a front perspective view of the new and improved film roping assembly as mounted upon a wrapping or packaging film dispensing carriage assembly.

Continuing still further, it is also seen that the new and improved film roping assembly 400 comprises a vertically oriented roping idler roller 428 which has its opposite ends thereof rotatably mounted within suitable mounting bracket portions 402*a* and 402*b* , and of the framework 402, as can best be appreciated from FIG. 6, and as can best be seen in FIGS. 4, 5, 9, and 10, the lower end portion of the roping idler roller 428 is provided with a frusto-conically shaped lower roping roller 430, the function of which will be described more fully hereinafter. In addition, it is also seen, as can best be appreciated from FIGS. 5 and 6, that the film roping assembly framework 402 further comprises a mounting bracket or plate 432 to which the drive motor 410 is fixedly mounted, by means of suitable bolt fasteners, not shown, and still further, the upper and lower mounting bracket portions 402*a* and 402*b* of the framework 402, upon which the opposite endv portions of the roping idler roller 428 are rotatably mounted, is provided with apertures, not shown, for accommodating suitable fasteners, also not shown, by means of which the entire film roping assembly 400 can be fixedly mounted upon a wrapping or packaging film dispensing carriage assembly 434 as illustrated within FIG. 8. The wrapping or packaging film dispensing carriage assembly 434 may comprise substantially any conventional wrapping or packaging film dispensing carriage assembly, and it is therefore to be appreciated that the wrapping or packaging film dispensing carriage assembly 434 is adapted to be mounted upon any one of the several different types of conventional film wrapping or packaging machines 100,200, and 300 as respectively illustrated within FIGS. 1-3 whereby, in turn, the new and improved film roping assembly 400 of the present invention can be utilized with any one of the several different types of conventional film wrapping or packaging machines 100, 200, and 300.

More particularly, it is seen, for example, that the wrapping or packaging film dispensing carriage assembly 434 comprises an upstanding spindle 436 upon which a roll of wrapping or packaging film, not illustrated, is adapted to be mounted, and that, for example, a suitable drive roller, and a suitable tension roller, both not illustrated, are adapted to be mounted upon the wrapping or packaging film dispensing carriage assembly 434 so as to be rotatably driven by means of a suitable drive system which comprises a drive motor 438, a first drive pulley 440 operatively connected to the output drive shaft of the drive motor 438, a first driven pulley 442 which is driven by means of a first drive belt 444 interconnecting the first driven pulley 442 to the drive pulley 440, a second driven pulley 446 which is coaxially mounted atop the first driven pulley 442, and a third driven pulley 448 which is driven by means of a second drive belt 450 interconnecting the second driven pulley 446 to the third driven pulley 448. In addition, a film outfeed idler roller 452 is also rotatably mounted upon the wrapping or packaging film dispensing carriage assembly 434 as a result of its oppositely disposed upper and lower end portions being rotatably mounted within upper and lower sections of the wrapping or packaging film dispensing carriage assembly framework.

Accordingly, it can be appreciated that the film path of the wrapping or packaging film, disposed upon and dispensed from the roll of wrapping or packaging film rotatably mounted upon the up-standing spindle 436, extends from the roll of wrapping or packaging film, passes through the aforenoted drive and tensioning rollers, not shown, passes around and across the front surface portion of the film outfeed idler roller 452, beneath the roping pulley 412, and around or behind the roping idler roller 428 so as to be conducted toward the palletized load to be wrapped or packaged within the wrapping or packaging film. It is lastly noted that while the endless drive chain 408 is illustrated as being visible, in reality, the endless drive chain 408 is entirely enclosed within a suitable housing, or enclosed by suitable covers, not actually illustrated but similar to the housing 454 which covers, for example, the idler sprocket 406.

Having described substantially all of the component parts of the new and improved film roping assembly 400, the operation of the same will now be described. More particularly, it is to be appreciated that all movements of the various component parts of the new and improved film roping assembly 400, as well as the actual dispensing of the wrapping or packaging film from the roll of wrapping or packaging film disposed upon the wrapping or packaging film dispensing carriage assembly 434 is adapted to be controlled by means of, for example, a programmable logic controller (PLC) which is schematically illustrated at 456 in FIG. 4. Accordingly, when a film wrapping or packaging operation or cycle is to be performed or initiated, the roping pulley 412 is disposed at its uppermost position as illustrated, for example, within any one of FIGS. 4, 5, 6, 8, and 9. In addition, wrapping or packaging film is dispensed from the roll of wrapping or packaging film disposed upon the upstanding spindle 436 of the wrapping or packaging film dispensing carriage assembly 434, and as has been noted hereinbefore, the path of film extends from the upstanding spindle 436, through the drive roller and tension roller assemblies, not shown, disposed upon the wrapping or packaging film dispensing carriage assembly 434, across the front surface portion of the film outfeed idler roller 452, and around the rear surface portion of the roping idler roller 428 so as to be directed toward the palletized load to be wrapped within the wrapping or packaging film.

As a result of the wrapping or packaging film being disposed along such a film path, the wrapping or packaging film passes directly beneath the roping pulley 412, and as can best be appreciated, for example, from FIGS. 5 and 7, the roping pulley 412 has an annular groove or recessed portion 458 formed within the external peripheral portion thereof such that the annular groove or recessed portion 458 of the roping pulley 412 is effectively disposed in a substantially coplanar manner with respect to the wrapping or packaging film being conveyed along the film path disposed beneath the roping pulley 412 when the roping pulley 412 is disposed at its uppermost position as illustrated within FIGS. 4, 5, 6, 8, and 9. Accordingly, at this point in time, and as schematically illustrated within FIG. 9, the film being dispensed and conducted toward the palletized load is characterized by means of its full width dimension FWD. However, when it is desired to form a roped section of the wrapping or packaging film at, for example, a predetermined time of the film wrapping or packaging operation or cycle, the programmable logic controller (PLC) 456 sends a signal to the drive motor 410 so as to cause the output shaft thereof to be rotated in the counterclockwise direction so as to, in turn, cause the drive sprocket 404 to be rotated in the counterclockwise direction. Accordingly, the drive chain 408 will be moved in the counterclockwise direction whereby the left side portion of the endless loop comprising the drive chain 408, upon which the roping pulley 412 is rotatably mounted, will be moved vertically downwardly while the right side portion of the endless loop comprising the drive chain 408 will be moved vertically upwardly.

Therefore, as the roping pulley 412 is moved vertically downwardly, by means of the drive chain 408 and as guided along the guide rail 420, the annular groove or recessed portion 458 of the roping pulley 412 will engage the upper edge portion of the wrapping or packaging film such that the upper edge portion of the wrapping or packaging film will be disposed within the annular groove or recessed portion 458 of the roping pulley 412. Accordingly, as the roping pulley 412 continues to be moved downwardly, the width dimension of the wrapping or packaging film will be continuously condensed between the downwardly moving roping pully 412 and the lower bracket portion 402*b* of the framework 402 until, for example, the roping pulley 412 reaches its lowermost position as illustrated within FIG. 10. At this point in time, the wrapping or packaging film is disposed in its roped state wherein the wrapping or packaging film has a minimized width dimension MWD which may be, for example, within the range of one-quarter inch (0.25") to one-half inch (0.50") wide. It is to be noted that as the roping pulley 412 approaches its lowermost position, the roped film will effectively be forced into a frusto-conically shaped recess effectively formed by means of the frusto-conically shaped lower roping roller 430 which therefore effectively serves to maintain the roped film at such position within the frusto-conically shaped recessed portion of the lower roping roller 430. It is to be noted further that the vertically downward travel or movement of the roping pulley 412 is terminated at its position illustrated within FIG. 10 as a result of the proximity target 422, disposed upon the right side portion of the endless loop comprising the drive chain 408 being disposed opposite the upper proximity sensor 424 whereby the upper proximity sensor 424 will sense the presence of the proximity target 422 and thereby transmit a control signal to the pro-grammable logic controller (PLC) 456 in order to terminate the drive of the drive motor 410.

Figure 11:
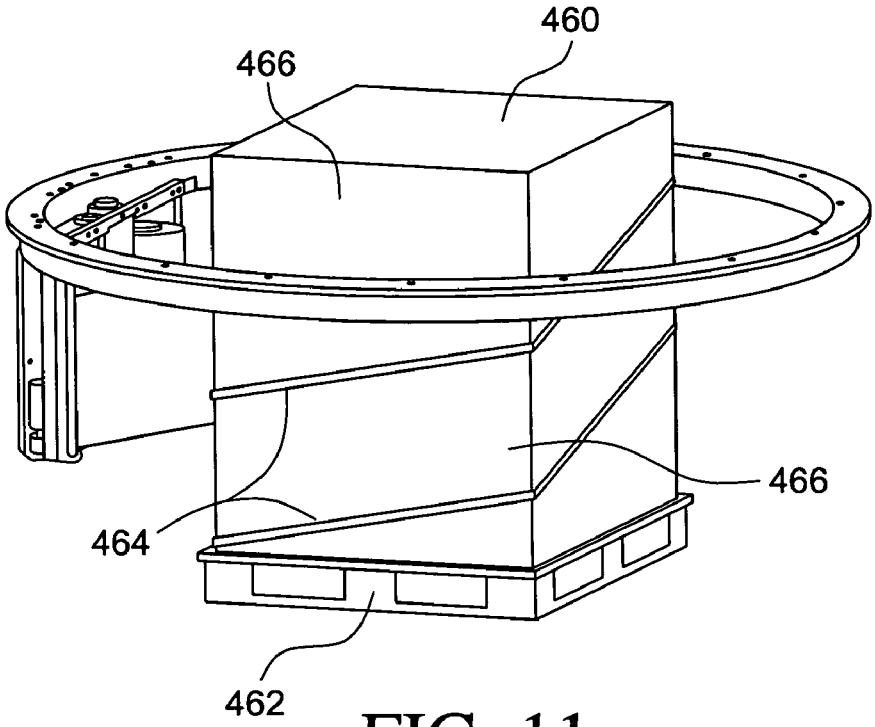
FIG. 11 is a perspective view of a palletized load being wrapped or packaged within wrapping or packaging film that comprises both roped and non-roped sections or portions of the wrapping or packaging film.
Figure 12:
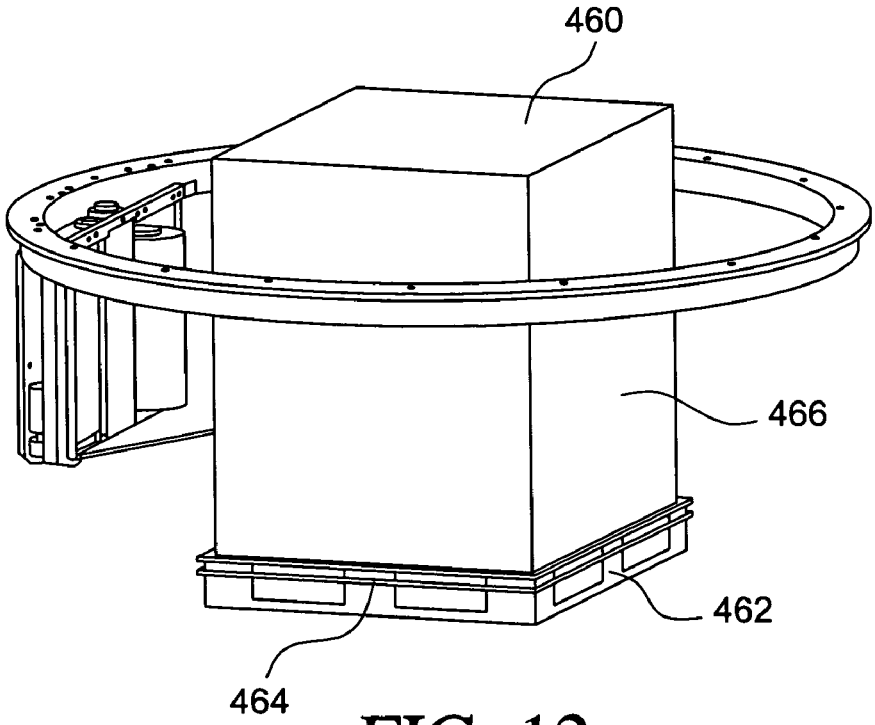
FIG. 12 is a perspective view of a palletized liad being wrapped or packaged within wrapping or packaging film the comprises both roped and non-roped sections or portions of the wrapping or packaging film, and wherein, in particular, the roped sections or portions of the wrapping or packaging film have been disposed around the pallet per se.

In a similar manner, when it is desired to permit the wrapping or packaging film to regain its full width dimension at, for example, a subsequent predetermined time of the film wrapping or packaging operation or cycle, the programmable logic controller (PLC) 456 sends a signal to the drive motor 410 so as to cause the output shaft thereof to be rotated in the reverse or clockwise direction so as to, in turn, cause the drive sprocket 404 to be rotated in the clockwise direction. Accordingly, the drive chain 408 will be moved in the clockwise direction whereby the left side portion of the endless loop comprising the drive chain 408, upon which the roping pulley 412 is rotatably mounted, will now be moved vertically upwardly while the right side portion of the endless loop comprising the drive chain 408 will be moved vertically downwardly. Therefore, as the roping pulley 412 is moved vertically upwardly, the width dimension of the wrapping or packaging film will be continuously expanded back to its full width dimension FWD until, for example, the roping pulley 412 reaches its uppermost original or start position as illustrated within FIGS. 4, 5, 6, 8, or 10. It is to be noted that the vertically upward travel or movement of the roping pulley 412 is terminated at its uppermost position illustrated within FIGS. 4, 5, 6, 8 or 10 as a result of the proximity target 423, disposed upon the right side portion of the endless loop comprising the drive chain 408, being disposed opposite the lower proximity sensor 426 whereby the lower proximity sensor 426 will sense the presence of the proximity target 423 and thereby transmit a control signal to the programmable logic controller (PLC) 456 in order to terminate the drive of the drive motor 410. It is to be further noted or appreciated that this operative cycle may be repeated at any one of a multiple number of times, if desired, throughout a single wrapping or packaging operation or cycle whereby the film, wrapping or packaging the particular palletized load, may comprise a plurality of sections comprising roped portions of the wrapping or packaging film, or full width portions of the wrapping or packaging film, depending upon, for example, the requirements of the particular palletized load. For example, as illustrated within FIG. 11, a palletized load 460 is disposed upon a pallet 462 and is wrapped within wrapping or packaging film which comprises, for example, roped sections 464 of the wrapping or packaging film and full width sections 466 of the wrapping or packaging film. In addition, as disclosed within FIG. 12, roped sections 464 of the wrapping or packaging film may be wrapped around the pallet 462 so as to effectively attach the palletized load 460 directly to the pallet 462.

Thus, it may be seen that in accordance with the principles and teachings of the present invention, there has been disclosed and described a new and improved film roping assembly which is disposed upon the wrapping or packaging film dispensing carriage assembly and which comprises a vertically reciprocable roping pulley which effectively forms a rope from the film wrapping or packaging material as a result of effectively compressing, condensing, or gathering the wrapping or packaging film along its width dimension. At the beginning of a film wrapping or packaging operation, the roping pulley is disposed at its uppermost position so as to be disposed directly above the upper edge portion of the wrapping or packaging film, being dispensed from the wrapping or packaging film dispensing carriage assembly, such that the annular groove of the roping pulley is, in effect, aligned in a coplanar manner with the wrapping or packaging film. Accordingly, when it is desired to form a roped portion of the packaging or wrapping film, the roping pulley is moved vertically downwardly in a transverse manner with respect to the direction in which the wrapping or packaging film is being dispensed such that the upper edge portion of the wrapping or packaging film will be disposed within the annular groove of the roping pulley, and as the roping pulley continues its downward movement, the wrapping or packaging film is effectively condensed or gathered along its width dimension or direction.

When the roping pulley effectively reaches its lowermost position, the wrapping or packaging film is completely formed into a roped section or portion of the wrapping or packaging film. This operative cycle can be repeated throughout a single film wrapping or packaging operation whereby different sections or portions of the wrapping or packaging film can comprise roped and non-roped structures so as to effectively dispose the roped portions or section of the wrapping or packaging film at strategic locations of the palletized load in order to significantly enhance the ability of the wrapping or packaging film to hold uneven, sharp, pointy, abrasive, unstable, and heavy products upon a pallet, to significantly enhance the ability of the wrapping or packaging film to hold different sections or portions of the palletized load together, or to significantly enhance the ability of the wrapping or packaging film to secure the composite palletized load upon the pallet.

Obviously, many variations and modifications of the present invention are possible in light of the above teachings. It is therefore to be understood that within the scope of the appended claims, the present invention may be practiced otherwise than as specifically described herein.

What is claimed as new and desired to be protected by Letters Patent of the United States of America, is:

1. A film roping assembly for use in connection with apparatus for wrapping an article within wrapping film, comprising:

a framework across which a wrapping film, having a predetermined original width dimension, is moved such that the wrapping film is conveyed in a direction extending along a film path;

a vertically oriented roping idler roller rotatably mounted, at opposite upper and lower end portions thereof upon upper and lower bracket portions of said framework, in a spaced manner with respect to a rear wall portion of said framework so as to define with said rear wall portion of said framework a space through which the wrapping film passes as the wrapping film is conveyed along said film path; and a single roping pulley, adapted to engage an upper edge portion of the wrapping film and movably mounted upon said framework for movement across the width of the wrapping film in a direction transverse to said film path as defined between the upper edge portion of the wrapping film and a lower edge portion of the wrapping film, so as to cooperate with said lower bracket portion of said framework in condensing the wrapping film into a roped film, having a reduced width dimension which is substantially less than the predetermined original width dimension of the wrapping film, while the wrapping film is also confined within said space defined between said rear wall portion of said framework and said vertically oriented roping idler roller.

2. The film roping assembly as set forth in claim 1, wherein:

said roping pulley has an annular groove defined within an outer peripheral surface portion thereof for engaging the upper edge portion of the wrapping film.

3. The film roping assembly as set forth in claim 1, wherein:

said roping pulley is mounted upon said framework so as to be movable in a reciprocal manner between a first position, at which said roping pulley is disengaged from the wrapping film such that the wrapping film, conveyed along said film path, retains its predetermined original width dimension, and a second position at which said roping pulley is engaged with the upper edge portion of the wrapping film and completely condenses the wrapping film to its roped film state.

4. The film roping assembly as set forth in claim 3, further comprising:

a drive chain;

means for mounting said roping pulley upon said drive chain; and a reversible drive motor operatively connected to said drive chain so as to move said drive chain in opposite directions so as to, in turn, move said roping pulley in said reciprocal manner between said first and second positions.

5. The film roping assembly as set forth in claim 4, further comprising:

a guide rail fixedly mounted upon said framework; and means for operatively connecting said roping pulley to said guide rail such that said roping pulley is guided by said guide rail during said reciprocal movements of said roping pulley between said first and second positions.

6. The film roping assembly as set forth in claim 5, wherein:

said means for operatively connecting said roping pulley to said guide rail, such that said roping pulley is guided by said guide rail during said reciprocal movements of said roping pulley between said first and second positions, comprises a slide block slidably mounted upon said guide rail.

7. The film roping assembly as set forth in claim 4, further comprising:

a pair of proximity sensors spaced a predetermined distance from each other; and proximity target means, disposed upon said drive chain, for operatively interacting with said pair of spaced proximity sensors such that when a first one of said pair of proximity sensors senses the presence of said proximity target means, operation of said reversible drive motor in a first direction is terminated so as to dispose said roping pulley at said first position, and when a second one of said pair of proximity sensors senses the presence of said proximity target means, operation of said reversible drive motor in a second direction is terminated so as to dispose said roping pulley at said second position.

8. The film roping assembly as set forth in claim 1, wherein:

said lower end portion of said vertically oriented roping idler roller has a substantially frusto-conically configured cross-sectional configuration for defining a substantially frusto-conically configured recess within which the roped film can be maintained.

9. The apparatus as set forth in claim 8, wherein:

said roping pulley has an annular groove defined within an outer peripheral surface portion thereof for engaging an edge portion of said wrapping film.

10. The apparatus as set forth in claim 8, wherein:

said roping pulley is mounted upon said framework so as to be movable in a reciprocal manner between a first position, at which said roping pulley is disengaged from said wrapping film such that said wrapping film, conveyed along said film path, retains its predetermined original width dimension, and a second position at which said roping pulley is engaged with the upper edge portion of said wrapping film and completely condenses said wrapping film to its roped film state.

11. The apparatus as set forth in claim 10, further comprising:

a drive chain;

means for mounting said roping pulley upon said drive chain; and a reversible drive motor operatively connected to said drive chain so as to move said drive chain in opposite directions so as to, in turn, move said roping pulley in said reciprocal manner between said first and second positions.

12. The apparatus as set forth in claim 11, further comprising:

a guide rail fixedly mounted upon said framework; and means for operatively connecting said roping pulley to said guide rail such that said roping pulley is guided by said guide rail during said reciprocal movements of said roping pulley between said first and second positions.

13. The apparatus as set forth in claim 12, wherein:

said means for operatively connecting said roping pulley to said guide rail, such that said roping pulley is guided by said guide rail during said reciprocal movements of said roping pulley between said first and second positions, comprises a slide block slidably mounted upon said guide rail.

14. The apparatus as set forth in claim 11, further comprising:

a pair of proximity sensors spaced a predetermined distance from each other; and proximity target means, disposed upon said drive chain, for operatively interacting with said pair of spaced proximity sensors such that when a first one of said pair of proximity sensors senses the presence of said proximity target means, operation of said reversible drive motor in a first direction is terminated so as to dispose said roping pulley at said first position, and when a second one of said pair of proximity sensors senses the presence of said proximity target means, operation of said reversible drive motor in a second direction is terminated so as to dispose said roping pulley at said second position.

15. Apparatus for wrapping an article within wrapping film, comprising:

a wrapping station at which an article, to be wrapped within wrapping film, is disposed;

a roll of wrapping film comprising a supply of said wrapping film to be wrapped around the article disposed at said wrapping station;

a wrapping film dispensing carriage assembly having said roll of wrapping film disposed thereon and defining a film path along which said wrapping film is dispensed such that said wrapping film extends from said roll of wrapping film toward the article disposed at said wrapping station; and a film roping assembly fixedly mounted upon said wrapping film dispensing carriage assembly for forming sections of said wrapping film, dispensed from said roll of wrapping film, into roped film to be disposed upon predetermined regions of the article being wrapped within said wrapping film;

said film roping assembly comprising a framework across which said wrapping film, having a predetermined original width dimension, is moved such that said wrapping film is conveyed in a direction extending along a film path; a vertically oriented roping idler roller rotatably mounted, at opposite upper and lower end portions thereof upon upper and lower bracket portions of said framework, in a spaced manner with respect to a rear wall portion of said framework so as to define with said rear wall portion of said framework a space through which said wrapping film passes as said wrapping film is conveyed along said film path; and a single roping pulley, adapted to engage an upper edge portion of said wrapping film and movably mounted upon said framework for movement across the width of said wrapping film in a direction transverse to said film path as defined between said upper edge portion of said wrapping film and a lower edge portion of said wrapping film, so as to cooperate with said lower bracket portion of said framework in condensing said wrapping film into a roped film, having a reduced width dimension which is substantially less than the predetermined original width dimension of said wrapping film, while said wrapping film is confined within said space defined between said rear wall portion of said framework and said vertically oriented roping idler roller.

16. The apparatus as set forth in claim 15, wherein:

said lower end portion of said vertically oriented roping idler roller has a substantially frusto-conically configured cross-sectional configuration for defining a substantially frusto-conically configured recess within which said roped film can be maintained.

17. A method of forming a roped film, from a wrapping film having a predetermined original width dimension, such that said roped film has a substantially reduced width dimension, comprising the steps of:

dispensing a wrapping film, having a predetermined original width dimension, along a film path defined upon a wrapping film dispensing carriage assembly;

rotatably mounting a vertically oriented roping idler roller, at opposite upper and lower end portions thereof upon upper and lower bracket portions of said wrapping film dispensing carriage assembly, such that said vertically oriented roping idler roller is disposed in a spaced manner with respect to a rear wall portion of said wrapping film dispensing carriage assembly so as to define with said rear wall portion of said wrapping film dispensing carriage assembly a space through which the wrapping film passes as the wrapping film is conveyed along said film path;

disposing a single roping pulley adjacent to said film path such that said single roping pulley is adapted to engage an upper edge portion of the wrapping film; and moving said single roping pulley across the width of the wrapping film in a direction transverse to said film path as defined between the upper edge portion of the wrapping film and a lower edge portion of the wrapping film, so as to engage the upper edge portion of the wrapping film and thereby cooperate with said lower bracket portion of said wrapping film dispensing carriage assembly in condensing the wrapping film, from its predetermined original width dimension into said roped film having a reduced width dimension which is substantially less than said predetermined original width dimension of the wrapping film, while the wrapping film is confined within said space defined between said vertically oriented roping idler roller and said rear wall portion of said wrapping film dispensing carriage assembly.

18. The method as set forth in claim 17, further comprising the step of:

providing said lower end portion of said vertically oriented roping idler roller with a substantially frusto-conically configured cross-sectional configuration for defining a substantially frusto-conically configured recess within which the roped film can be maintained.

19. The method as set forth in claim 17, further comprising the step of:

forming said roping pulley having an annular groove defined within an outer peripheral surface portion thereof; and moving said roping pulley from a first position, at which said roping pulley is disengaged from the wrapping film so as to permit the wrapping film to be conveyed along said film path while retaining its predetermined original width dimension, and a second position at which said roping pulley is engaged with the wrapping film and completely condenses the wrapping film to its roped film state.

20. The method as set forth in claim 19, further comprising the step of:

moving said roping pulley in a reciprocal manner between said first and second positions so as to form said roped film within predetermined sections of the wrapping film.

21. The method as set forth in claim 20, further comprising the step of:

utilizing proximity sensors to control the reciprocal movements of said roping pulley in order to selectively position said roping pulley at either one of said first and second positions.

22. The method as set forth in claim 20, further comprising the step of:

mounting said roping pulley upon a drive chain; and operatively connecting a reversible drive motor to said drive chain so as to move said drive chain in opposite directions so as to, in turn, move said roping pulley in said reciprocal manner between said first and second positions.

23. The method as set forth in claim 20, further comprising the steps of:

fixedly mounting a guide rail upon said wrapping film dispensing carriage assembly; and operatively connecting said roping pulley to said guide rail such that said roping pulley is guided by said guide rail during said reciprocal movements of said roping pulley between said first and second positions.

24. The method as set forth in claim 23, further comprising the steps of:

mounting a slide block upon said guide rail; and mounting said roping pulley upon said slide block so as to guide said reciprocal movements of said roping pulley between said first and second positions.

* * * * *